US006638151B2

(12) United States Patent
Ueno

(10) Patent No.: US 6,638,151 B2
(45) Date of Patent: Oct. 28, 2003

(54) POLISHING INSTRUMENT

(75) Inventor: Makoto Ueno, Tagajo (JP)

(73) Assignee: Tateo Uegaki, Miyagi (JP)

( * ) Notice: Subject to any disclaimer, the term of this patent is extended or adjusted under 35 U.S.C. 154(b) by 20 days.

(21) Appl. No.: 09/958,426

(22) PCT Filed: Feb. 9, 2001

(86) PCT No.: PCT/JP01/00958

§ 371 (c)(1),
(2), (4) Date: Oct. 9, 2001

(87) PCT Pub. No.: WO01/58645

PCT Pub. Date: Aug. 16, 2001

(65) Prior Publication Data

US 2002/0182992 A1 Dec. 5, 2002

(30) Foreign Application Priority Data

Feb. 9, 2000 (JP) ..... 2000-32514

(51) Int. Cl.[7] ..... B24B 23/02

(52) U.S. Cl. ..... 451/359; 451/511; 451/516; 451/495; 451/536; 125/36

(58) Field of Search ..... 451/359, 548, 451/353, 539, 488, 456, 514, 516, 519, 520, 158, 259, 495, 536, 511; 15/230.1, 230.14, 16, 18

(56) References Cited

U.S. PATENT DOCUMENTS 1,725,361 A * 8/1929 Mall ..... 451/511
1,778,470 A * 10/1930 Stratford ..... 451/511
1,779,682 A * 10/1930 Stratford ..... 451/511
2,349,365 A * 5/1944 Martin et al. ..... 451/536
3,123,947 A * 3/1964 Rawley ..... 451/495
3,824,745 A * 7/1974 Hutchins ..... 451/359
3,932,966 A 1/1976 Stern
4,058,936 A * 11/1977 Marton ..... 451/359
4,287,685 A * 9/1981 Marton ..... 451/359
5,927,264 A * 7/1999 Worley ..... 125/36
5,993,305 A 11/1999 Chu

FOREIGN PATENT DOCUMENTS

JP 53 126414 3/1980
JP 55 102386 2/1982

* cited by examiner

*Primary Examiner*—George Nguyen
(74) *Attorney, Agent, or Firm*—Alston & Bird LLP

(57) ABSTRACT

The present invention relates to a polishing instrument for polishing a surface into a predetermined configuration. The present invention aims to provide a polishing instrument superior in operability and stability and capable of polishing a surface into a desired configuration. The polishing instrument of the present invention includes: a rotatable rotary substrate portion equipped with a polishing plane holding a polishing material on its surface; a plurality of movable substrate portions equipped with polishing planes which hold the polishing material on their surfaces, which are provided in the peripheral edge of the rotary substrate portion, and which rotate about a connection line connecting them to the rotary substrate portion; and elastic members for biasing the polishing planes of the movable substrate portions toward a position where they are flush with the polishing plane of the rotary substrate portion.

8 Claims, 14 Drawing Sheets

PRIOR ART

POLISHING INSTRUMENT

TECHNICAL FIELD

The present invention relates to a polishing instrument for polishing a surface into a predetermined shape and, in particular, to a polishing instrument which can be suitably used for the sheet metal repair of a vehicle.

BACKGROUND ART

Regarding sheet metal repair for dealing with flaws, dents, etc. generated on a painted surface of a vehicle, such as an automobile, substrate preparing procedures will be briefly described. First, as shown in FIG. 12, a coating film removing processing is performed to remove coating films, such as a primer 51, a surfacer 52, and a paint 53, from a steel plate 50.

Further, simultaneously with or after the coating film removing processing, a process for removing feather edges F is performed as shown in FIG. 13. The process for removing feather edges F is for generating smooth inclined portions (inclined by approximately 27 to 54 degrees) which extend from the steel plate surface 50 of the damaged portion D to the normal painted surface. Note that, the process for removing feather edges F is performed in order to improve the adhesion (holding) of putty P, with which the damaged portion D is filled afterward, and to restrain the reduction in the volume of the putty P as it cures, thereby making it possible to obtain a putty filling surface which is as flat as possible. And, the dent of the damaged portion D from which the coating films and feather edges F have been removed is elicited by a sliding hammer or the like, and then the dent is filled with putty P to form a putty-filled portion constituting the substrate in the damaged portion D. Note that, in the following, the damaged portion D is also referred to as the surface to be polished.

Conventionally, in this substrate preparing process, a rotary polishing device S, such as a discs sander or a double action sander, is generally used. As shown in FIG. 14, such a rotary polishing device S has a rotation mechanism 101 using compressed air or electricity as its power source, and a round polishing instrument 104 having a polishing paper 103 on the front side is detachably attached to a rotation shaft 102 provided on the rotation mechanism 101. And, the polishing instrument 104 which is rotated by the rotation mechanism 103 is brought into contact with the damaged portion D to effect polishing.

Also, apart from the polishing device S, which simply polishes the damaged portion D, there is a dust collecting type polishing device which performs polishing while collecting the dust (polishing chips, etc.) generated during polishing by a suction device provided at a predetermined position.

Here, a disc sander and a double action sander, which are generally used to remove paint and feather edges, will be described. In the disc sander, the rotation center of the rotation shaft 102 of the polishing device S is in alignment with that of the polishing instrument 104. The polishing instrument 104 rotates (revolves), as the rotation shaft 102 of the polishing device S rotates. On the other hand, in the double action sander, the rotation center of the polishing instrument 104 is offset from that of the rotation shaft 102, and the polishing instrument 104 rotates in eccentricity with respect to the polishing device S.

The polishing instrument 104 supported by the polishing device S is composed of a round holding plate 106 provided with an arbor 105 supported by the rotation shaft 102 of the polishing device S, and a polishing pad 107 which is secured to the lower side of the holding plate 106 and to the lower side of which a sand paper serving as the polishing member is detachably attached. As the rotation shaft 102 of the polishing device S rotates, the polishing pad 107 rotates. Note that, the holding plate 106 is a rigid member formed of a resin or the like, and the polishing pad 107 is formed of an elastic material such as a hard sponge.

When using this polishing device S, for example, as shown in FIG. 14, polishing is performed while holding the polishing device S by both hands in such a manner that the polishing instrument 104 is somewhat inclined with respect to the damaged portion D. That is, polishing is performed by using an end portion 108 of the polishing pad 104. Note that, polishing by using the end portion 108 of the polishing instrument 104 is performed because the contact area and the contact pressure of the polishing pad 104 with respect to the damaged portion D can be easily changed according to the polishing condition.

However, when a person who is not used to this type of polishing device uses the polishing device, excessive or uneven polishing can result. This is particularly true in the case of the process for removing coating films and feather edges, in which polishing is performed by using an end portion of the polishing instrument.

The reasons for this are as follows. Firstly, when performing polishing by using an end portion of the polishing instrument, the area by which the instrument is held in contact with the damaged portion is small, so that it is difficult for the user to adjust the pressure with which the polishing instrument is held in contact with the damaged portion. Secondly, since the polishing pad is formed of an elastic member, such as a hard sponge, any fluctuation in the contact pressure or any change in the contact angle will result in great deformation of the polishing pad, thereby impairing the stability of the polishing instrument with respect to the damaged portion.

In addition, according to the above-mentioned reasons, in the polishing using the conventional polishing instrument, the operating direction of the polishing device S with respect to the dent of the damaged portion D is limited. Specifically, as shown in FIG. 12, it is impossible to perform polishing while inclining the polishing instrument in the direction in which the polishing device S advances. This is because the pressurizing force applied to the polishing device acts on the end portion of the polishing instrument rotating at high speed to further increase the deformation amount of the polishing instrument, thereby impairing the stability of the instrument.

Thus, to obtain a satisfactory polished face by using the conventional polishing instrument, it takes a lot of skill and a careful operation.

Further, since the polishing pad is formed of an elastic material, such as a hard sponge, continuous polishing by using its end portion results in a local deterioration of the polishing pad, making it necessary to replace the polishing instrument at an early stage.

The present invention has been made in view of the above problems. It is an object of the present invention to provide a polishing instrument which is superior in operability and stability and which makes it possible to polish a surface into a desired shape by an easy operation. Another object of the present invention is to provide a polishing instrument which has a superior durability and which makes it possible to continuously perform polishing by using its end portion.

DISCLOSURE OF THE INVENTION

The polishing instrument of the present invention comprises: a rotatable rotary substrate portion equipped with a polishing plane holding a polishing material on its surface; a plurality of movable substrate portions equipped with polishing planes which hold the polishing material on their surfaces, which are provided in the peripheral edge of the rotary substrate portion, and which rotate about a connection line connecting them to the rotary substrate portion; and biasing means for biasing the polishing planes of the movable substrate portions toward a position where they are flush with the polishing plane of the rotary substrate portion.

In the polishing instrument of the present invention, the polishing plane is composed of a plurality of planes. When polishing is performed by using an end portion of the polishing instrument, the polishing planes provided in the movable substrate portions are brought into contact with the surface to be polished. That is, in the polishing instrument of the present invention, the portion corresponding to the end portion of the conventional polishing pad constitutes the movable substrate portions. Note that, the area of the polishing planes of the movable substrate portion is sufficiently smaller than that of the polishing plane of the entire polishing instrument.

Thus, when performing polishing by using the end portion, there is no great variation in the contact area of the polishing plane and the surface to be polished. Further, the pressure with which the polishing instrument is held in contact with the surface to be polished can be easily adjusted. Thus, an improvement is achieved in terms of the stability of the polishing instrument with respect to the surface to be polished, and it is possible, without any special skill, to polish the surface to be polished into a desired configuration by an easy operation.

Further, in the polishing instrument of the present invention, even if polishing is performed while inclining the polishing instrument toward the direction in which the polishing instrument advances, the polishing plane undergoes deformation while maintaining a predetermined configuration, so that the sense of stability is not impaired, making it possible to obtain a satisfactory polishing plane. Further, even if polishing is continuously performed by using the end portion of the polishing instrument, the polishing planes of the movable substrate portions of the polishing instrument are in contact with the surface to be polished, so that no undue stress is applied to the end portion of the polishing instrument, making it possible to restrain a deterioration in the end portion.

Further, in accordance with the present invention, there is provided a polishing instrument according to the first aspect of the invention further comprising a holding plate provided so as to be parallel to the rotary substrate portion and the movable substrate portions and at a predetermined distance therefrom, and elastic members provided between the holding plate and the movable substrate portions. The polishing planes of the movable substrate portions may be biased by the elasticity of the elastic members from the holding plate side toward a position where they are flush with the polishing plane of the rotary substrate portion.

In this construction, the biasing means is provided between the movable substrate portions and the holding plate so as to be erect. Thus, it is possible to directly apply an external force (pressurizing force) to the movable substrate portions to perform polishing. Therefore, a further improvement is achieved in terms of the stability of the polishing instrument with respect to the damaged portion. Further, apart from the provision of a biasing means, it is possible to absorb the slight vibration due to the contact between the polishing instrument and the damaged portion.

Further, in the polishing instrument of the present invention, the rotary substrate portion is circular, and the movable substrate portions can be provided at a plurality of positions at equal intervals in the circumference of the rotary substrate portion. In this construction, the connection line between the movable substrate portions and the rotary substrate portion runs in an arc, so that the bent portion extending from the rotary substrate portion to the movable substrate portions can be smoothly brought into contact with the dent inner surface of the damaged portion. Further, since the movable substrate portions are provided at a plurality of positions at equal intervals in the circumference of the rotary substrate portion, the contact (rotation) resistance as a result of the rotation of the polishing instrument with respect to the damaged portion is uniform over the entire circumference, thereby stabilizing the rotation of the polishing instrument.

Further, in the polishing instrument of the present invention, the outer end edges of the plurality of movable substrate portions can form one and the same curve. That is, in the condition in which the rotary substrate portion and the movable substrate portions are connected to each other, the outer end edges of the movable substrate portions form a continuous arc. Thus, the outer end edges of the movable substrate portions can be smoothly brought into contact with the dent inner surface of the damaged portion.

Further, in the polishing instrument of the present invention, the area of the polishing planes of the movable substrate portions can be smaller than the area of the polishing plane of the rotary substrate portion. In this construction, when performing polishing by using the entire polishing plane consisting of the rotary substrate portion and the movable substrate portion, the rotary substrate portion which makes little movement relative to the holding plate comes into contact with the surface to be polished in a large area. Thus, the polishing instrument is stable even when polishing is performed by using the entire polishing plane.

Further, in the polishing device of the present invention, the movable range for the movable substrate portions with respect to the rotary substrate portion can be determined to be between a position where the polishing planes of the movable substrate portions are flush with the polishing plane of the rotary substrate portion and a position where a part of the movable substrate portions is in contact with the side edge of the holding plate. By thus setting the movable range of the movable substrate portions beforehand, even a person who is not used to the operation of a polishing instrument, if he performs polishing within the movable range, can maintain the contact angle made by the damaged portion and the polishing instrument within an appropriate range.

Further, in the polishing instrument of the present invention, at least one elastic member may be provided for each of the plurality of movable substrate portions. By thus arbitrarily setting the number of elastic members provided in each movable substrate portion, it is possible to obtain movable substrate portions having a desired restoring force (elastic force). Further, since a biasing means is provided for each movable substrate portion, each movable substrate portion individually comes into contact with the damaged portion with a predetermined contact pressure. Thus, it is possible to perform polishing with higher accuracy by using the end portion of the polishing instrument.

Further, in the polishing instrument of the present invention, there may be provided a dust collecting passage extending through each of the polishing planes, the elastic members, and the holding plate. The dust collecting passage may be connected to a suction device using a negative pressure as the suction source. In this construction, the dust generated on the polishing plane can be guided to the suction device by utilizing the dust collecting passage. That is, it is possible to obtain a polishing instrument adapted to a dust collecting type polishing instrument.

As described above, the present invention provides a polishing instrument which is superior in operability and stability, making it possible to polish a surface into a desired configuration by an easy operation.

Further, since the portion corresponding to the end portion of the polishing instrument is formed of a plate of a resin or the like, a superior durability can be achieved. In addition, it comes into face contact with the surface to be polished, thereby improving the durability of the end portion. Thus, polishing can be continuously conducted by using the end portion of the polishing instrument. Further, local excessive wear of the sand paper can be restrained.

Further, in the polishing instrument of the present invention, even when performing polishing by using the end portion of the instrument, it can be brought into contact with the surface to be polished by a large contact area. Further, the operation of the polishing instrument requires no particularly careful handling. Thus, it is possible to remove old coating films in a short time.

BEST EMBODIMENT MODE FOR CARRYING OUT THE INVENTION

Hereinafter, a preferred embodiment of the present invention will be described in detail with reference to the drawings.

Figure 1:
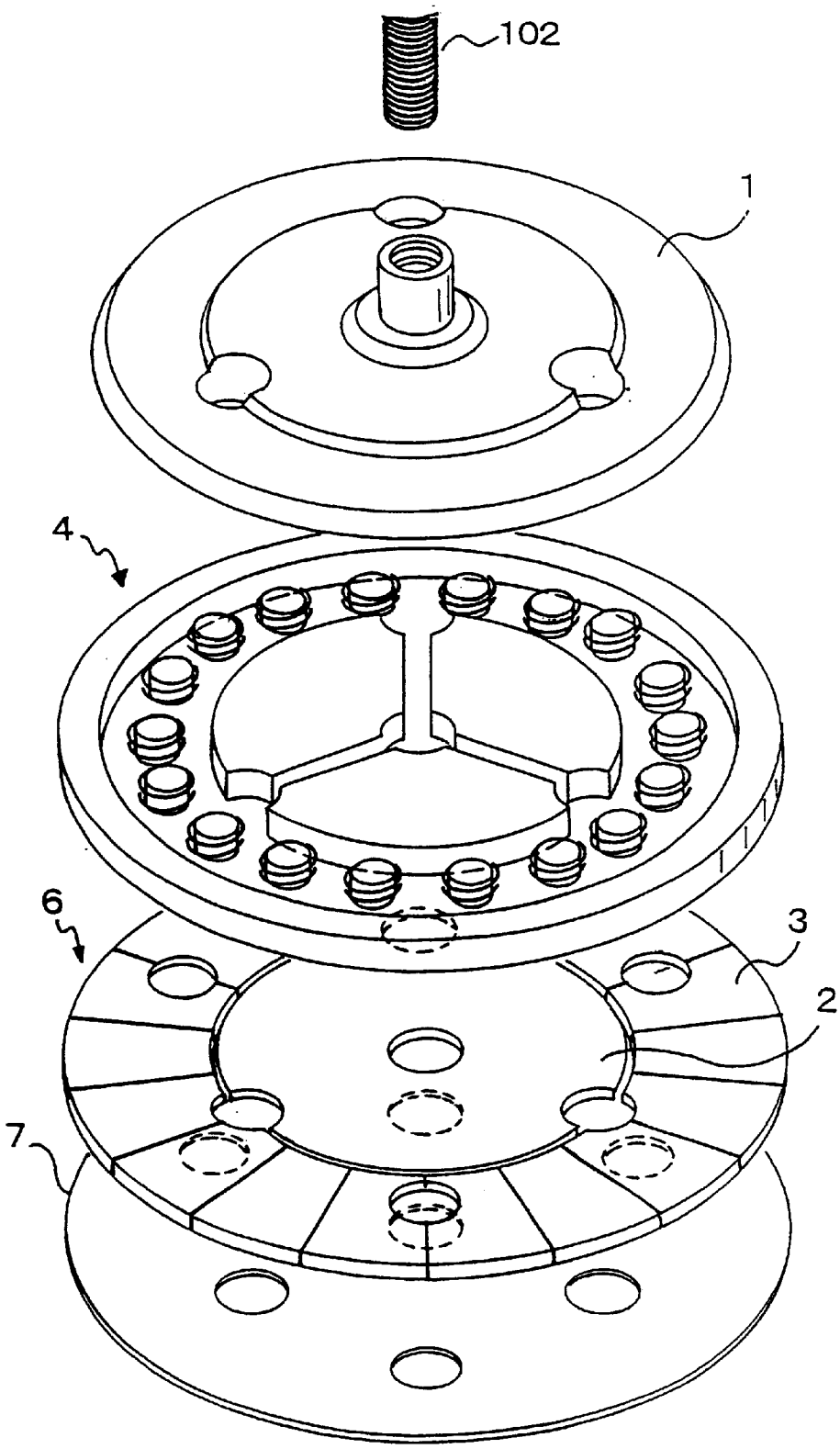
FIG. 1 is an exploded perspective view of a polishing instrument according to an embodiment of the present invention.
Figure 2:
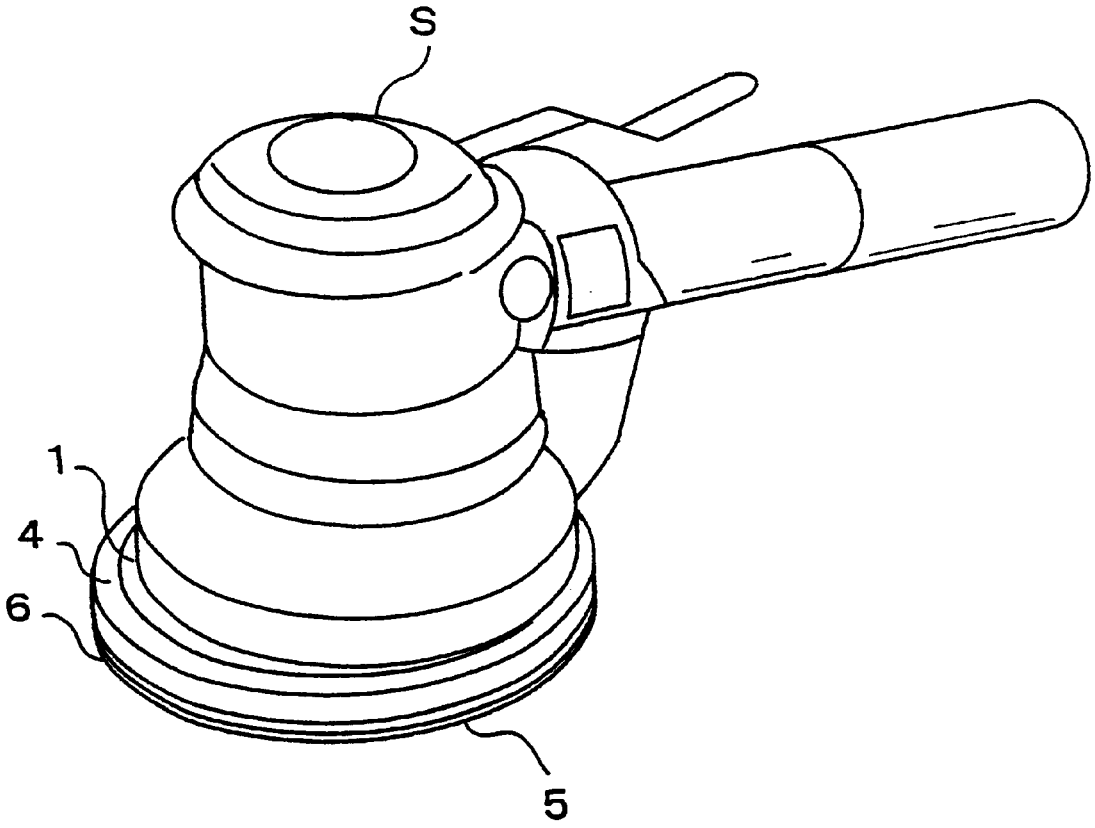
FIG. 2 shows a polishing device to which the polishing instrument of the embodiment of the present invention is attached.
Figure 3:
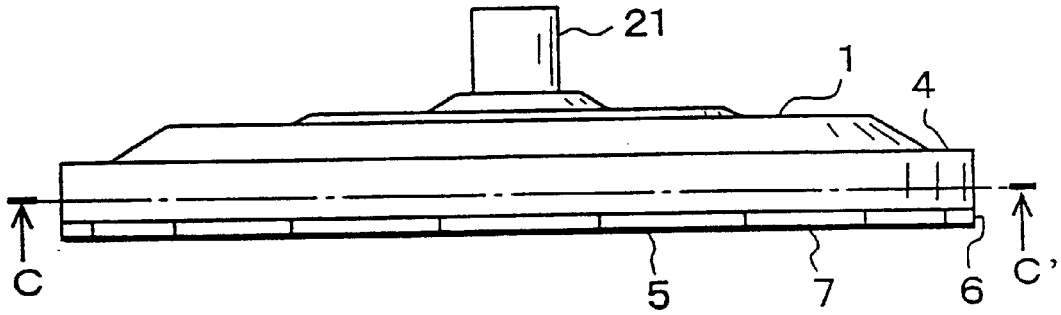
FIG. 3 is a front view of the polishing instrument of the embodiment of the present invention.

First, a polishing instrument according to the embodiment will be schematically described with reference to FIG. 1. The polishing instrument is composed of a circular holding plate 1 detachably attached to a rotation shaft 102 of a polishing device and adapted to rotate as the rotation shaft 102 rotates, a circular polishing plate 6 which is arranged below and parallel to the holding plate 1 at a predetermined interval and which consists of a rotary substrate portion 2 and a plurality of movable substrate portions 3, an elastic member 4 provided between the polishing plate 6 and the holding plate 1, and an adhesive sheet 7 attached to the lower surface of the polishing plate 6.

And, a polishing surface 5 for polishing a damaged portion corresponds to the lower side of the polishing plate 6 forming the rotary substrate portion 2 and the movable substrate portions 3, and a sand paper serving as the polishing material is attached to the polishing surface 5 through the intermediation of the adhesive sheet 7. Here, the terms downward or lower side indicate the direction of the damaged portion when the polishing instrument of this embodiment is used.

While it is desirable that the polishing device S causing the holding plate 1 to rotate be a polishing device, such as a disc sander or a double action sander, mentioned above, it may also be, for example, a small polishing device (luter) or the like for working on ornaments. In this embodiment, a polishing instrument is attached to a dust collecting type double action sander having a dust collecting function.

The holding plate 1 detachably attached to the polishing device S is a circular plate consisting of a resin, a metal or the like and has at a position somewhat deviated from its center an arbor 21 to be engaged with the rotation shaft 102 of the polishing device S. And, this arbor 21 is supported by the rotation shaft of the polishing device S, and the holding plate 1 rotates as the rotation shaft 102 of the polishing device S rotates. A male screw is formed on the rotation shaft 102 of the polishing device S, and a female screw is formed in the arbor 21 provided on the holding plate 1. Thus, the holding plate 1 can be easily attached to and detached from the polishing device S.

Under the holding plate 2, there is provided through the intermediation of the elastic member 4 a circular polishing plate 6 forming the rotary substrate portion 2 and the movable substrate portions 3 so as to be parallel to the holding plate 1 and at a predetermined interval. The polishing plate 6 is a 2 mm thick disk formed of a resin material, such as PVC (polyvinyl chloride), and its outer diameter is somewhat larger than that of the holding plate 1. Further, a sand paper is attached to its lower side through the intermediation of an adhesive sheet 7. A plurality of recesses and protrusions are provided on the surface of the adhesive sheet 7, making it possible to easily replace the sand paper.

Figure 6:
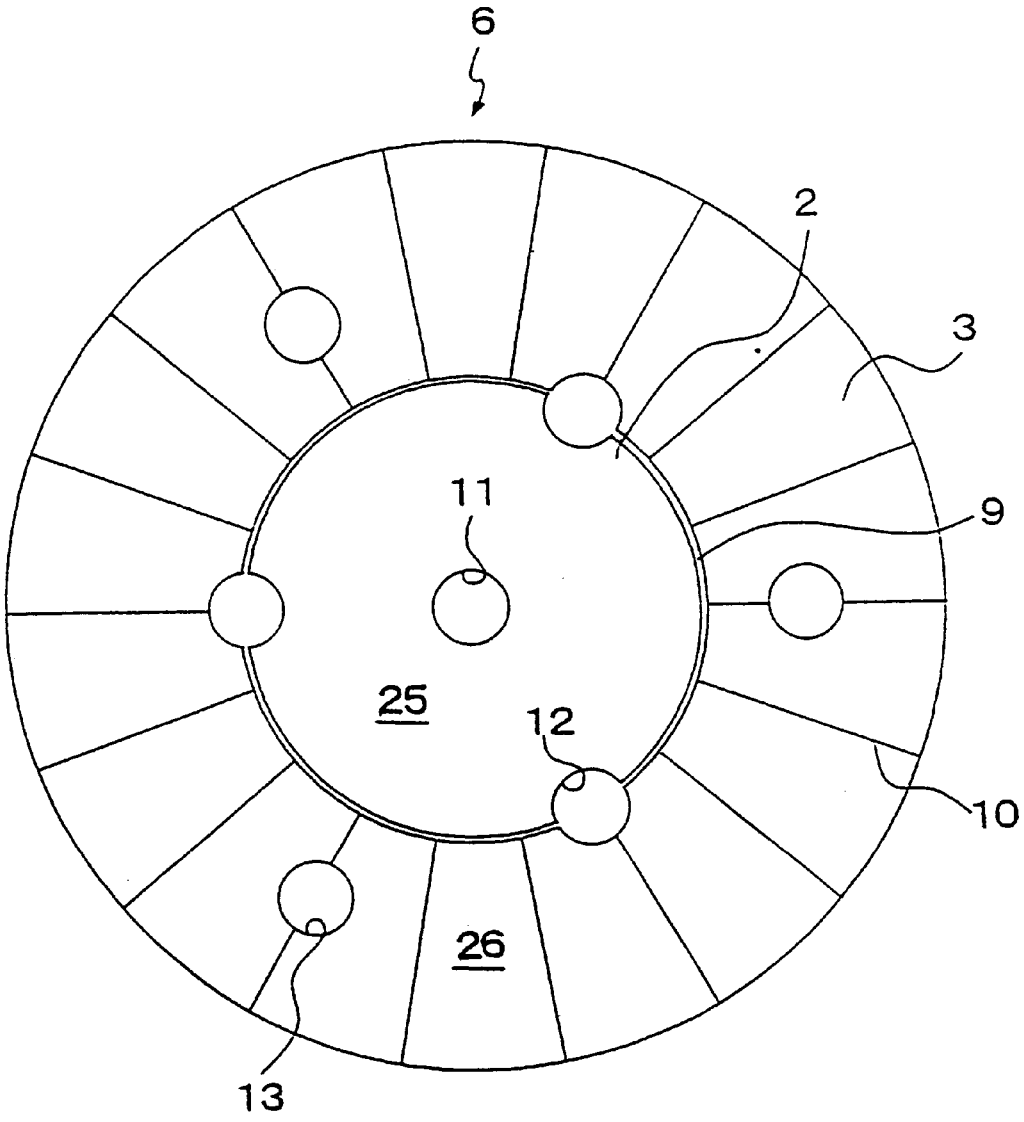
FIG. 6 is a diagram showing a polishing plate of the polishing instrument of the embodiment of the present invention.

Further, the polishing plate 6, as shown in FIG. 6, has a first cutting line 9 which is at a position corresponding to approximately ½ of the radius of the plate as measured radially from the center and which constitutes a circle concentric with respect to the polishing plate 6. Further, a plurality of second cutting lines 10 extend radially from 18 points at equal intervals in the circumference of the first cutting line 9 toward the end portion of the polishing plate 6.

Thus, the polishing plate 6 is composed of a circular panel 25 formed inside the first cutting line 9 and a plurality of substantially fan-shaped panels 26 divided by the first cutting line 9 and the second cutting lines 10. The circular panel 25 and the substantially fan-shaped panels 26 are connected through the adhesive sheet 7 provided under the polishing plate 6, so that the panels 25 and 26 form the circular polishing plate 6 without being deviated from their respective positions.

Further, the first cutting line 9 has a width of approximately 1 mm, so that the plurality of substantially fan-shaped panels 26 formed on the outer side of the first cutting line 9 can respectively make a vertical swinging movement about the first cutting line 9. That is, in this embodiment, the circular panel 25 on the inner side of the first cutting line 9 constitutes the rotary substrate portion 2, and the plurality of substantially fan-shaped panels 26 constitute the movable substrate portion 3. In the following, the circular panel 25 will be referred to as the rotary substrate portion 2, and the substantially fan-shaped panels will be referred to as the movable substrate portions 3.

Note that, in this embodiment, a slight positional deviation generated between adjacent movable substrate portions 3 is permissible due to the ductility of the adhesive sheet 7. It is also possible for the second cutting lines 10 provided in the polishing plate 6 to have a V-shaped sectional configuration.

While in this embodiment the rotary substrate portion 2 and the movable substrate portions 3 are joined to each other through the adhesive sheet 7, it is also possible to join them by providing a thin-walled flange, a hinge or the like where the first cutting line is 9 provided. The term thin-walled flange here means a type of rotating means consisting of a linear thin-walled portion formed in an arbitrary member, a part of the arbitrary member being rotatable around the thin-walled portion.

In this way, in the polishing instrument of this embodiment, the polishing surface 5 coming into contact with the damaged portion D is composed of a plurality of surfaces, and the movable substrate portions 3 corresponding to the end portion of the polishing plate 6 swing vertically with respect to the rotary substrate portion 2 constituting the center of the polishing plate 6.

Further, the polishing plate 6 forming the rotary substrate portion 2 and the movable substrate portions 3 has a plurality of dust collecting holes for capturing dust (polishing chips) generated when polishing the damaged portion D. Specifically, the dust collecting holes consist of a first dust collecting hole 11 provided at the center of the rotary substrate portion 2, second dust collecting holes 12 provided at three positions at equal intervals in the circumference of the first cutting line 9, and third dust collecting holes 13 provided in the movable substrate portion 3 and situated between the adjacent second dust collecting holes 12 (See FIG. 6).

Note that, these dust collecting holes 11, 12, and 13 will be described in detail along with the elastic member 4 provided between the holding plate 1 and the polishing plate 6.

Figure 7:
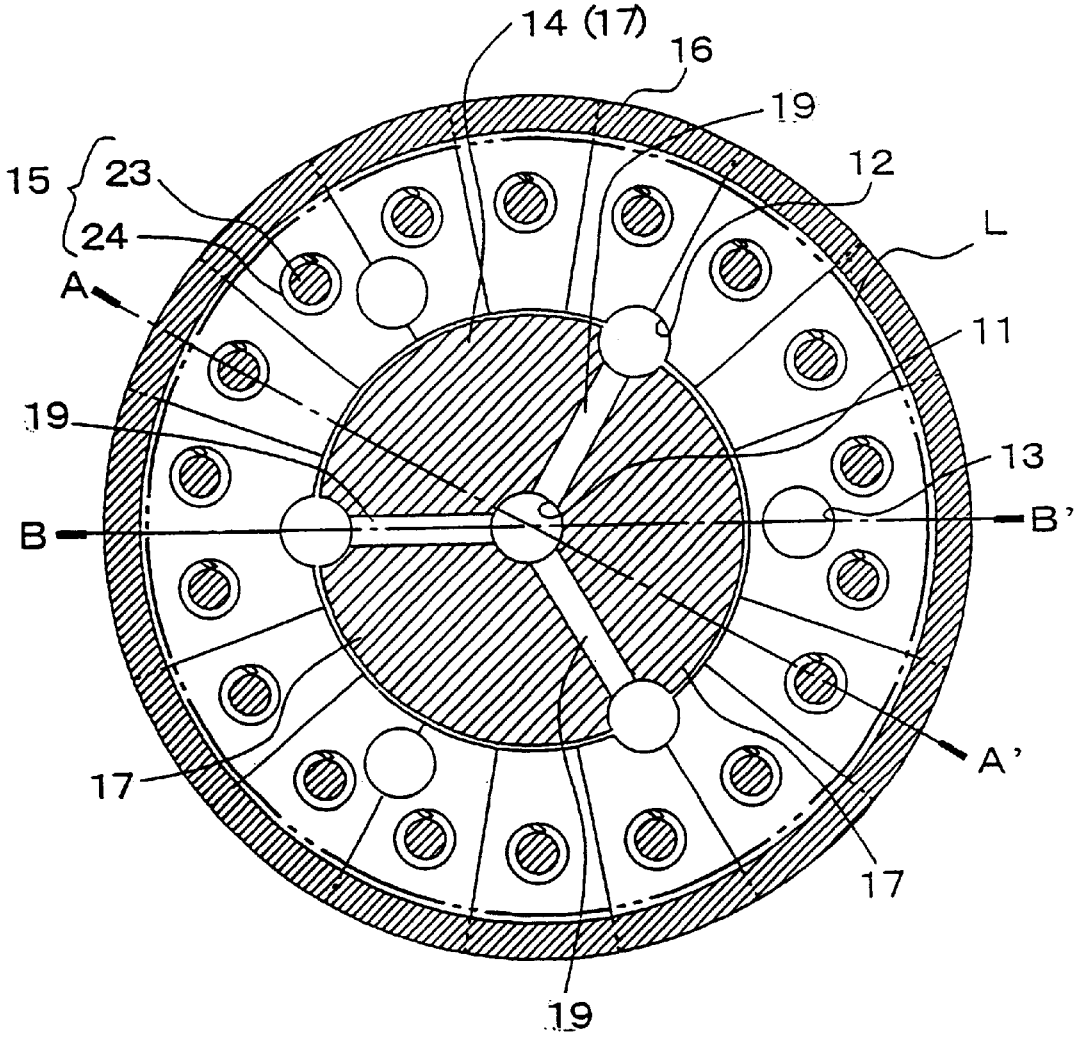
FIG. 7 is a sectional view taken along the line C–C' of the polishing instrument of the embodiment of the present invention.
Figure 8:
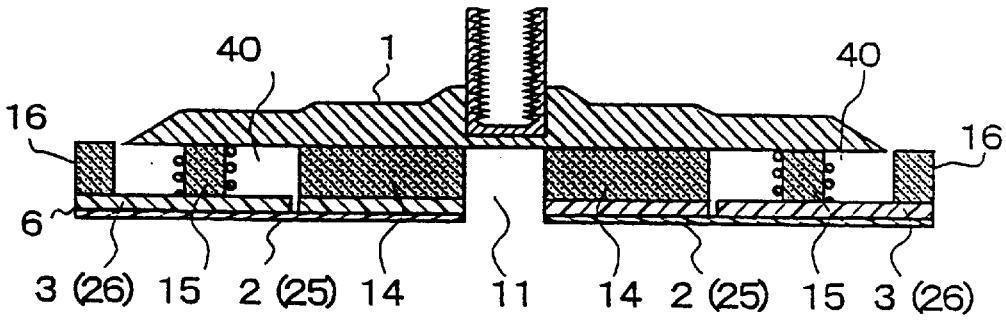
FIG. 8 is a sectional view taken along the line A–A' of the polishing instrument of the embodiment of the present invention.
Figure 9:
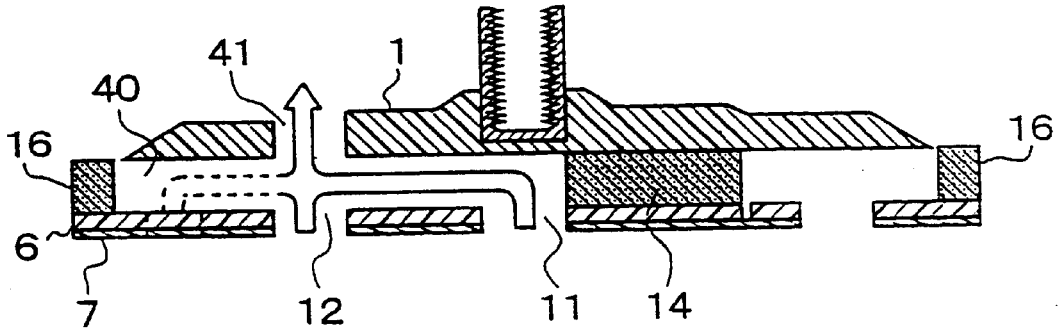
FIG. 9 is a sectional view taken along the line B–B' of the polishing instrument of the embodiment of the present invention.

As shown in FIGS. 7 through 9, the elastic member 4 is composed of first support members 14 for securing the circular panel 25 constituting the rotary substrate portion 2 to the holding plate 1, second support members 15 for securing the substantially fan-shaped panels 26 constituting the movable substrate portions 3 to the holding plate 1, and a side wall member 16 forming a dust collecting passage 40 communicating with the dust collecting holes 11, 12, and 13 inside the polishing instrument.

As shown in FIG. 7, the first support members 14 have the same diameter as the rotary substrate portion 2, and consist of three equal hard sponges 17 divided by three positions at equal intervals in the circumference thereof and having a substantially fan-shaped outer configuration. And, each of the first support members is attached to the rotary support portion 2 and the holding plate 1. Note that, in this condition, gaps 9 are provided between the adjacent first support members 14, and the first dust collecting hole 11 and the second dust collecting holes 12 communicate with each other through these gaps 19. Thus, the first dust collecting hole 11 and the second dust collecting holes 12 constitute one continuous passage.

Note that, the first support members 14, which are formed of an elastic hard sponge, have a large support area for the rotary substrate portion 2. As a result, the rotary substrate portion 2 is secured in position so as not to greatly move with respect to the holding plate 1.

The second support members 15 are composed of a plurality of hard sponges 23 formed as cylinders and coil springs 24 wound around the outer peripheries of the hard sponges 23. One of these hard sponges 23 and one of these coil springs 24 are provided substantially at the center of each movable substrate portion 3.

The horizontal cross sectional area of the second support members 15 is sufficiently smaller than that of the first support members 14 securing the rotary substrate portion 2 to the holding plate 1, and the second support members can be easily deflected with fingers. Thus, the strength with which the movable substrate portions 3 are secured to the holding plate 1 is sufficiently weaker than the strength with which the second rotary substrate portion 2 is secured to the first support members, the movable substrate portions 3 allowing themselves to be easily brought close to the holding plate 1.

Figure 10:
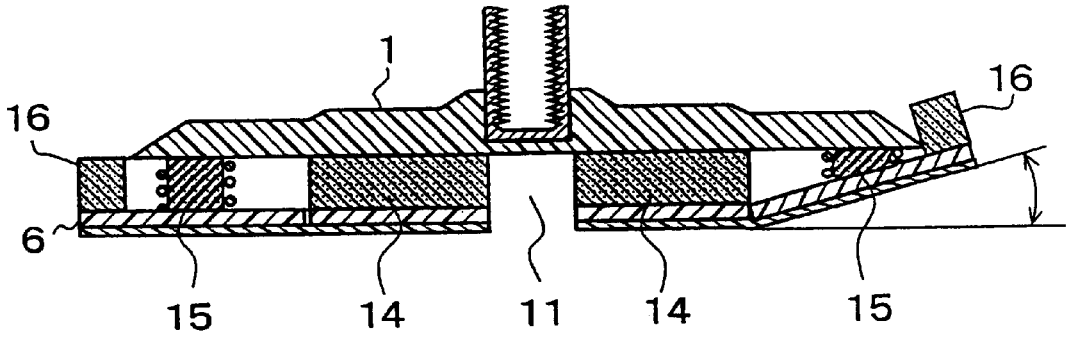
FIG. 10 is a sectional view taken along the line A–A', showing a state in which a movable substrate portion of the polishing instrument of the embodiment of the present invention moves.

Thus, when an external force (pressurizing force) is applied to a movable substrate portion 3, the movable substrate portion 3 swings toward the holding plate 1 about the connection line between it and the rotary substrate portion 2, that is, the first cutting line 9 (See FIG. 10). When the external force applied to the movable substrate portion 3 is eliminated, the movable substrate portion 3 is restored to the position where it is flush with the rotary substrate portion 2 due to the tensile force of the coil spring 24 and the restoring force of the cylindrical hard sponge 23. When an external force is continuously applied to the rotary substrate portion 2, the upper side of the movable substrate portion 3 comes into contact with the side edge of the holding plate 1, restricting rotation of the movable substrate portion 3.

The movable range of the movable substrate portion 3 can be easily varied by, for example, varying the diameter or configuration of the holding plate 1. It is also possible to vary the movable range by varying the thickness of the elastic member 4. The movable range of the movable substrate portion 3 is determined such that when the polishing instrument is operated within that range, a satisfactory polishing surface 5 can be easily obtained. Specifically, it is desirable for the range to be determined such that the movable substrate portion 3 is allowed to be upwardly inclined by up to 20 degrees from the position where it is flush with the rotary substrate portion 2.

Next, the side wall member 16 forming inside the polishing instrument the dust collecting passage communicating with the plurality of dust collecting holes 11, 12, and 13 will be described. The side wall member 16 consists of a hard sponge formed as a ring having a rectangular vertical cross-sectional configuration, and has an inner diameter substantially equal to the diameter of the holding plate 1 and an outer diameter equal to the diameter of the polishing plate 6. And, it is attached to the polishing plate 6 so as to extend a long its edge. The imaginary line L in FIG. 7 indicates the end portion of the holding plate 1.

And, in the state in which the side wall member 16 is arranged on the polishing plate 6, as shown in FIG. 8, the space which is defined between the movable substrate portion 3 and the holding plate 1 and whose width is equal to the thickness of the elastic member 4 provides inside the polishing instrument a dust collecting passage 40 shielded from the atmosphere, with the side wail member 16 serving as a shield against the atmosphere. And, the second dust collecting holes 12 and the third dust collecting holes 13 open on this dust collecting passage 40.

Provided in the holding plate 1 is a suction hole 41 extending through the holding plate 1 and connected to the dust collecting passage 40 (See FIG. 9). The suction hole 41 is connected to a suction device provided in the polishing device S and using negative pressure as the suction source. The dust generated during polishing is captured by way of the dust collecting holes 11, 12, and 13, the dust collecting passage 40, the suction hole 41, and the suction device. FIGS. 8 and 9 are sectional views taken along the lines A–A' and B–B', respectively, of FIG. 7.

In this way, in the polishing instrument of the present invention, the dust generated during polishing between the surface polished and the polishing plate 6 is sucked through the dust collecting passage 40 and can be efficiently guided to the suction device having a negative pressure source.

Next, a method of using the polishing instrument of this embodiment will be described.

When removing the old coating films remaining in the damaged portion D, first, only the movable substrate portions 3 are brought into contact with the old coating films to polish the same. At this time, a sand paper of No. 60 to 80 is attached to the polishing surface, and the polishing is performed, replacing the sand paper according to the polishing state of the damaged portion D.

Note that, a disc sander is usually used as the polishing device S for removing the old coating films. The polishing instrument of the present invention, which is of the type in which the arbor 21 supported by the polishing device S is provided at the center of the holding plate 1, is used.

Figure 4:
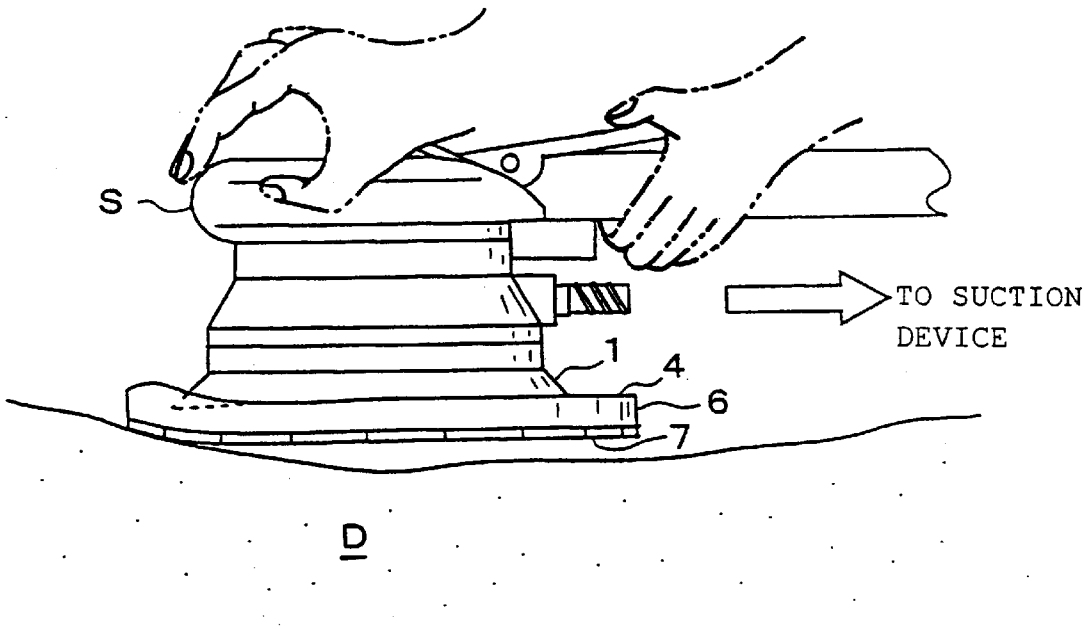
FIG. 4 is a diagram showing a use state of the polishing device to which the polishing instrument of the embodiment of the present invention is attached.
Figure 5:
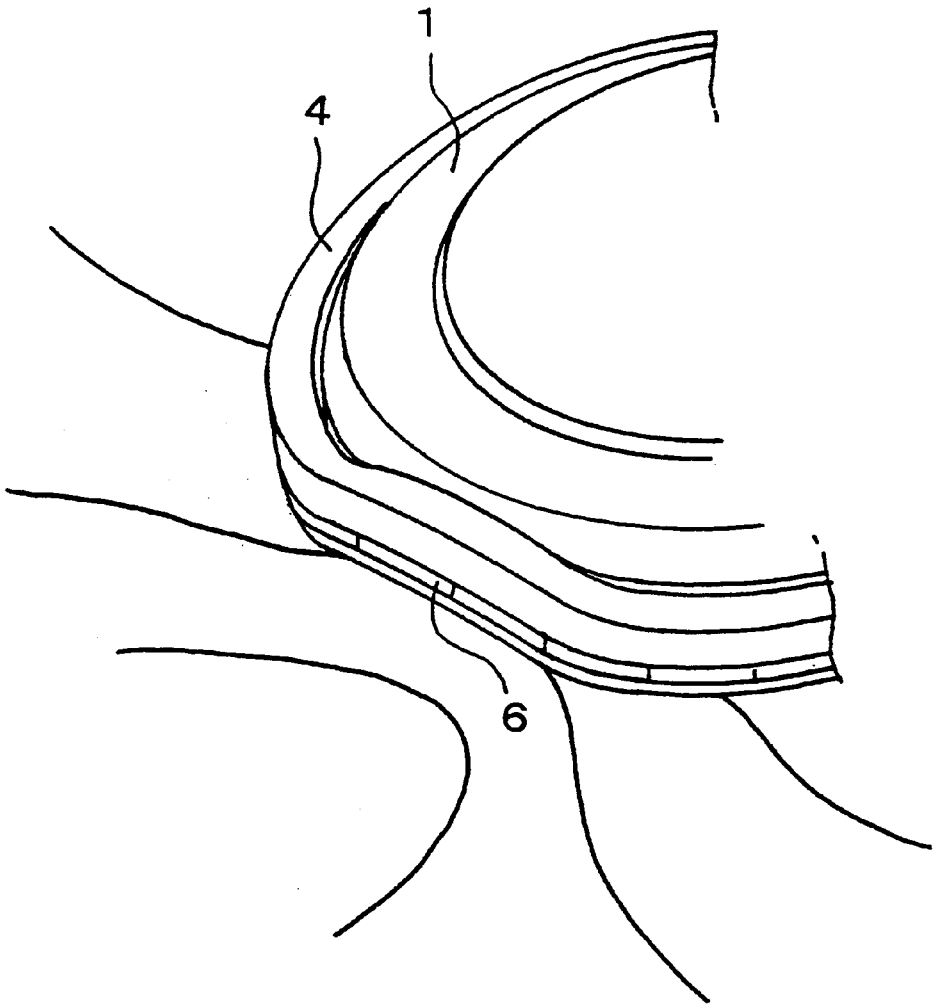
FIG. 5 is a diagram showing a state in which an end portion of the polishing instrument of the embodiment of the present invention is movable.

Thereafter, feather edges F are removed from the damaged portion D from which the old coating films have been removed. The process for removing feather edges F is first performed, as shown in FIG. 4, from the damaged portion D, from which the old coating films have been removed, to the normal coating films by using the movable substrate portions 3 of the polishing instrument. To form feather edges whose inclination angle is fixed in a short time, feather flaws are first roughly imparted to the damage portion D. Here, the feather flaws, which are imparted by rough cutting, serve as a guide for making the polishing amount of the feather edges F constant.

And, polishing is performed so as to remove the feather flaws to obtain smooth feather edges. Note that, in the process for removing the feather edges, a double action sander is used, so that the polishing instrument of this embodiment is adopted.

When straightening up the feather edges, the polishing instrument is moved from the inner side of the dent toward the outer side thereof, and from the outer side of the dent toward the inner side thereof. At this time, since the polishing instrument of the present invention is highly stable with respect to the surface to be polished, it is also possible to perform polishing while inclining it toward the direction in which the polishing device S advances, making it possible to remove the feather edges in a shorter time.

In the following, a coating film separation test using the polishing instrument of the present invention will be described. Note that, this coating film separation test was conducted in order to grasp the polishing characteristics of the polishing instrument of the present invention.

TEST EXAMPLE

Using a double action sander to which the above-described polishing instrument of this embodiment is attached, coating on the panel surface of an automobile is removed. The person operating the double action sander is not highly skilled in the operation of the polishing device S; his or her skill in the operation is average in the art.

[Specimen]

The coating film used is one (having a thickness of 125 to 130 $\mu$m) formed on the automobile panel surface by painting. More specifically, the specimen consist of a wash primer (4 to 8 $\mu$m) a surfacer (30 to 50 $\mu$m), a base coat (30 to 40 $\mu$m), and a clear (40 to 60 $\mu$m) formed in that order on a steel plate constituting the panel.

[Test Method]

First, the double action sander is operated such that the end portion of the polishing instrument comes into contact with the coating surface to determine the starting point T. Subsequently, within the range of 25 cm from the starting point T, the polishing device is moved linearly at a fixed speed and a fixed angle while gradually reducing the pressure applied to the movable substrate portions.

[Test Results]

Figure 11:
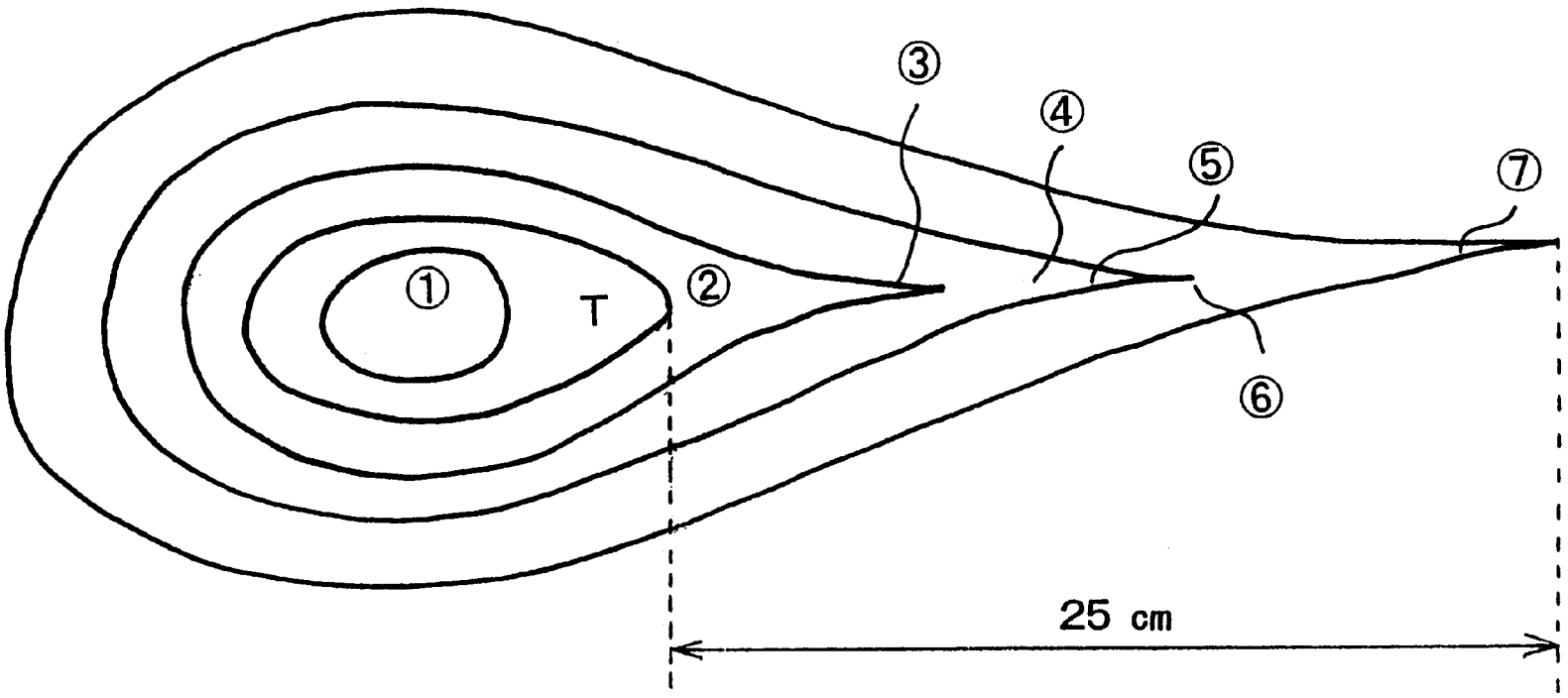
FIG. 11 is a diagram showing in contour lines a polishing state achieved by a coating film separation test conducted by using the polishing instrument of the embodiment of the present invention.
Figure 12:
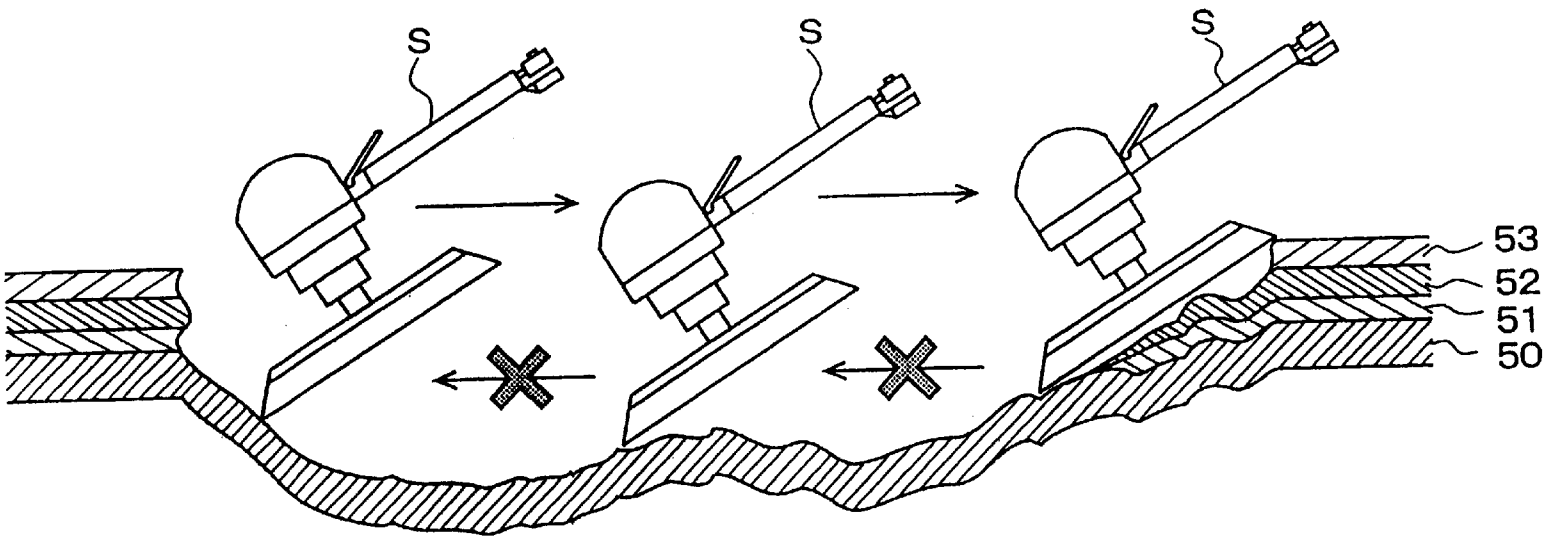
FIG. 12 PRIOR ART
FIG. 12 is a diagram showing how a conventional polishing device is used in a coating film removing process.
Figure 13:
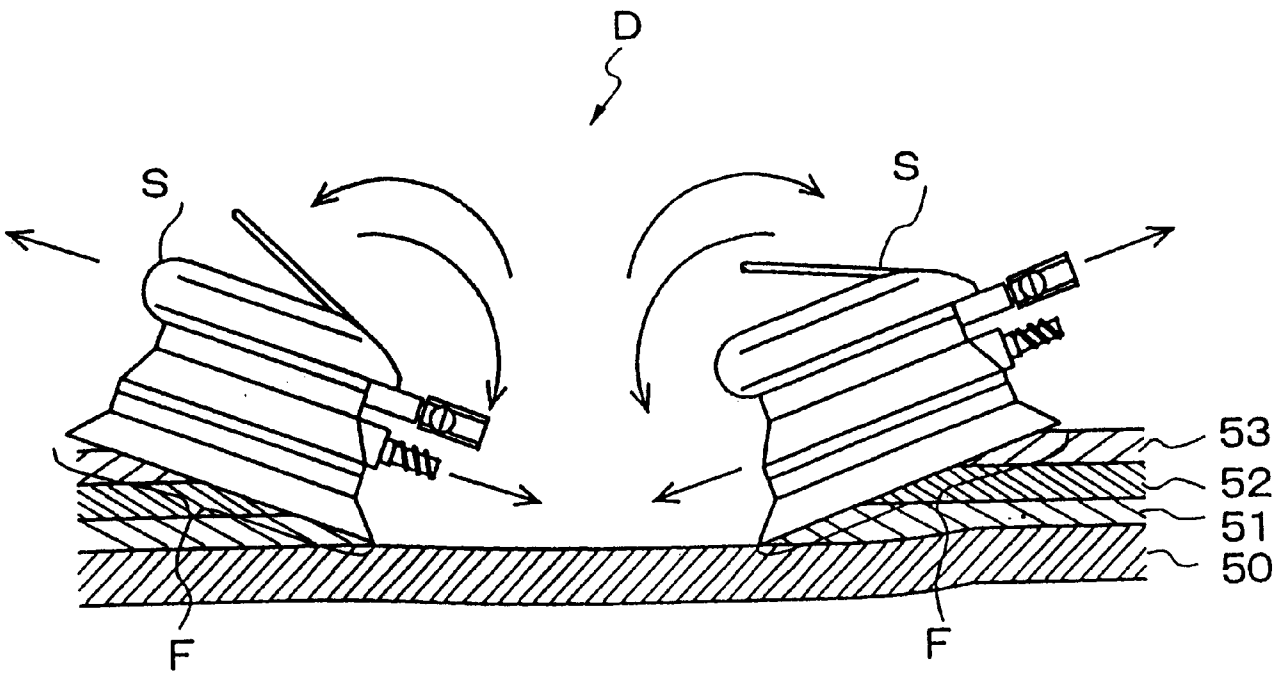
FIG. 13 PRIOR ART
FIG. 13 is a diagram showing a use state of a conventional polishing device in a feather edge removing process.
Figure 14:
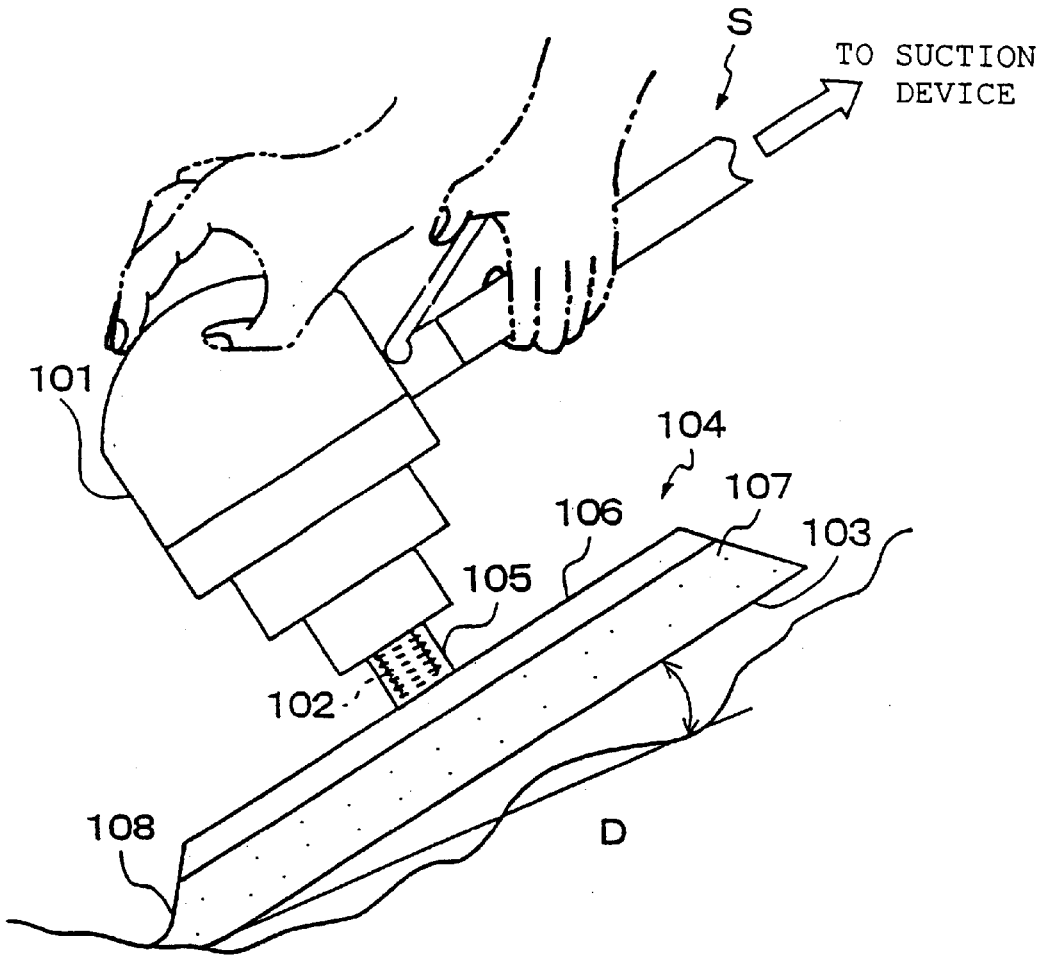
FIG. 14 is a diagram showing a use state of a conventional polishing device.

FIG. 11 is a diagram showing the remaining paint amount after the test. Note that, the continuous curves in the drawing indicate contour lines and numerals (1) through (7) indicate measurement points. Table 1 shows the respective remaining paint amounts at the measurement points. The polishing characteristics of the polishing instrument, which can be read from FIG. 11 and Table 1, can be grasped from the paths of movement of the polishing instrument and the distances between the contour lines corresponding to the paths of movement of the polishing instrument.

TABLE 1

| Measurement point | Remaining paint amount: im |
|---|---|
| 1 | 10 im–20 im |
| 2 | 30 im |
| 3 | 60 im |
| 4 | 74 im |
| 5 | 120 im |
| 6 | 130 im |
| 7 | 170 im |

First the polishing characteristics of the polishing instrument of the present invention will be considered from the conditions of the paths of movement of the polishing instrument. In the double action sander to which the polishing instrument of the present invention is attached, it is to be assumed that there is little deflection of the polishing instrument with respect to the coated surface. This can be inferred from the fact that the path of movement of the polishing instrument is in a straight line as shown in FIG. 11.

One of the reasons for the little deflection of the polishing instrument is that the portion of the polishing instrument corresponding to the end portion thereof consists of a plane (movable substrate portion), so that there is little variation in the area with which the polishing instrument is held in contact with the coated surface. Further, due to the fact that surplus pressurizing force applied to the polishing instrument is absorbed by the elastic member provided between the holding plate and the movable substrate portions, it is to be assumed that there is little fluctuation in the pressure with which the polishing instrument is held in contact with the coated surface.

These factors contribute to an improvement in the stability of the polishing instrument, and, as shown in FIG. 11, the path of movement of the polishing instrument is in a straight line. Thus, in the process of removing feather edges, the process of removing coating films, etc., the double action sander to which the polishing instrument of the present invention is attached is capable of reliably polishing a desired range only.

Next, the polishing characteristics of the polishing instrument of the present invention will be considered from the distances between the contour lines in the path of movement of the polishing instrument. The double action sander to which the polishing instrument of the present invention is attached is relatively free from fluctuation in the polishing amount with respect to the coated surface. This can be inferred from the large-distanced contour lines in the path of movement of the polishing instrument shown in FIG. 11.

This is due to the fact that even in the case of polishing by using an end portion of the polishing instrument, the coated surface and the polishing instrument are in face contact with each other in the present invention, so that polishing is possible in a large polishing range corresponding to the length (width) of the contact surface. Note that, the length (width) of the contact surface here corresponds to the entire length of the movable substrate portion. Further, it is to be assumed that due to the elastic member provided between the holding plate and the movable substrate portion, any unnecessary pressurizing force applied to the polishing instrument is absorbed, thereby reducing the fluctuation in contact pressure with respect to the coated surface.

In this way, the double action sander to which the polishing instrument of the present invention is attached is capable of performing polishing so as to achieve large-distanced contour lines. Thus, for example, in the process of removing feather edges, etc., it is possible to easily form smooth inclined portions (feather edges) at a predetermined angle.

The present invention is not restricted to the above-described embodiment. Various modifications are possible for a person skilled in the art without departing from the scope of the invention as defined by the claims.

What is claimed is:

1. A polishing instrument comprising: a central rotary substrate portion having a surface defining a polishing plane for holding a polishing material thereon, the rotary substrate portion having an outer peripheral edge; a plurality of movable substrate portions each having a surface defining a polishing plane for holding the polishing material thereon, each movable substrate portion being pivotally connected to the peripheral edge of the rotary substrate portion such that the polishing planes of the movable substrate portions are free to become inclined relative to the polishing lane of the rotary substrate portion; and biasing means for biasing the movable substrate portions toward a position where the polishing planes of the movable substrate portions are flush with the polishing plane of the rotary substrate portion.

2. A polishing instrument according to claim 1, further comprising a holding plate provided so as to be parallel to the rotary substrate portion and the movable substrate portions and at a predetermined distance therefrom, and elastic members provided between the holding plate and the movable substrate portions, characterized in that the polishing planes of the movable substrate portions are biased by the elasticity of the elastic members from the holding plate side toward a position where they are flush with the polishing plane of the rotary substrate portion.

3. A polishing instrument according to claim 1, characterized in that: the rotary substrate portion is circular; and the movable substrate portions are provided at a plurality of positions at equal intervals in the circumference of the rotary substrate portion.

4. A polishing instrument according to claim 1, characterized in that the outer end edges of the plurality of movable substrate portions form one and the same curve.

5. A polishing instrument according to claim 1, characterized in that the area of the polishing planes of the movable substrate portions is smaller than the area of the polishing plane of the rotary substrate portion.

6. A polishing instrument according to claim 2, characterized in that the movable range for the movable substrate portions with respect to the rotary substrate portion is determined to be between a position where the polishing planes of the movable substrate portions are flush with the polishing plane of the rotary substrate portion and a position where a part of the movable substrate portions is in contact with the side edge of the holding plate.

7. A polishing instrument according to claim 2, characterized in that at least one elastic member is provided for each of the plurality of movable substrate portions.

8. A polishing instrument according to claim 2, further comprising a dust collecting passage extending through each of the polishing planes, the elastic members, and the holding plate, characterized in that the dust collecting passage is connected to a suction device using a negative pressure as the suction source.

* * * * *

UNITED STATES PATENT AND TRADEMARK OFFICE

CERTIFICATE OF CORRECTION

PATENT NO. : 6,638,151 B2
DATED : October 28, 2003
INVENTOR(S) : Ueno

It is certified that error appears in the above-identified patent and that said Letters Patent is hereby corrected as shown below:

Column 12,
Line 11, “lane” should read -- plane --.

Signed and Sealed this

Thirteenth Day of January, 2004

JON W. DUDAS
*Acting Director of the United States Patent and Trademark Office*